US009781781B2

(12) United States Patent
Huang et al.

(10) Patent No.: US 9,781,781 B2
(45) Date of Patent: Oct. 3, 2017

(54) VERTICAL POWER SUPPLY FOR LAMP

(71) Applicant: Changzhou Jutai Electronic Co., Ltd., Changzhou (CN)

(72) Inventors: Wei Huang, Changzhou (CN); Jun Lin, Changzhou (CN); Chengqian Pan, Changzhou (CN); Bin Chen, Changzhou (CN)

(73) Assignee: Changzhou Jutai Electronic Co., Ltd., Changzhou (CN)

( * ) Notice: Subject to any disclaimer, the term of this patent is extended or adjusted under 35 U.S.C. 154(b) by 0 days.

(21) Appl. No.: 15/297,133

(22) Filed: Oct. 19, 2016

(65) Prior Publication Data

US 2017/0135166 A1 May 11, 2017

(30) Foreign Application Priority Data

Nov. 10, 2015 (CN) ..... 2015 2 0891835 U

(51) Int. Cl.

| | |
|---|---|
| ***H05B 37/02*** | (2006.01) |
| ***H01R 33/955*** | (2006.01) |
| ***F21S 8/00*** | (2006.01) |
| ***H05B 33/08*** | (2006.01) |
| ***H01H 13/14*** | (2006.01) |
| ***H01H 13/06*** | (2006.01) |

(52) U.S. Cl.

CPC ..... *H05B 33/0809* (2013.01); *H01H 13/06* (2013.01); *H01H 13/14* (2013.01); *H05B 37/02* (2013.01)

(58) Field of Classification Search

CPC ..... H05B 33/08; H05B 33/0809; H05B 33/0815; H05B 37/02; H01H 13/04; H01H 13/06; H01H 13/14; H01R 33/955; F21S 8/00; F21S 8/035

See application file for complete search history.

(56) References Cited

U.S. PATENT DOCUMENTS

| | | | | |
|---|---|---|---|---|
| 2011/0098530 | A1* | 4/2011 | Yamane | A61B 1/00172 600/109 |
| 2014/0036511 | A1* | 2/2014 | Whitfield | F21V 27/005 362/311.02 |
| 2015/0091471 | A1* | 4/2015 | Shan | B60Q 3/43 315/294 |

* cited by examiner

*Primary Examiner* — Thai Pham

(74) *Attorney, Agent, or Firm* — Wayne & King LLC

(57) ABSTRACT

The invention discloses a vertical power supply for a lamp. The vertical power supply for the lamp comprises a shell formed in an integrated mode and a tail cover, wherein one end of the shell is closed and the other end is provided with an opening; the tail cover is fixedly connected with the opening end of the shell; and a hole is formed in the tail cover. The vertical power supply for the lamp further comprises a circuit board with a control circuit, a switch for generating a pulse signal and a sealing piece, wherein at least one part of the circuit board is mounted in a cavity of the shell; one end of the switch is welded and fixed on the circuit board, and the other end of the switch is a free end; the sealing piece is mounted in the hole of the tail cover to seal the hole; and after the tail cover and the shell are fixed, the sealing piece abuts against the free end of the switch and one end of the sealing piece is exposed in the air. The vertical power supply for the lamp has the advantages of simple structure and good waterproof performance.

10 Claims, 17 Drawing Sheets

VERTICAL POWER SUPPLY FOR LAMP

CROSS-REFERENCE TO RELATED APPLICATIONS

This application claims priority of Chinese Patent Application No. 201520891835.0 with a filing date of Nov. 10, 2015. The content of the aforementioned application, including any intervening amendments thereto, are incorporated herein by reference.

TECHNICAL FIELD

The present invention relates to the technical field of lightning, in particular to a vertical power supply for a lamp.

BACKGROUND OF THE PRESENT INVENTION

The current LED power supply with a control function commonly adopts a horizontal structure. As shown in the FIG. 1 and the FIG. 2, the horizontal structure comprises a shell, a circuit board, a conductive button and an output waterproof socket, the shell consists of an upper cover 1 and a lower cover 2, and a mounting hole is formed in the upper cover 1. In assembly, the conductive button 3 is assembled in the mounting hole, the circuit board 4 is mounted in the shell, and the output waterproof socket 5 is mounted in a groove of the tail part of the upper cover 1; and after the lower cover 2 covers the upper cover 1, the upper cover 1 and the lower cover 2 are welded by ultrasonic wave, and the output waterproof socket 5, the upper cover 1 and the lower cover 2 are welded by the ultrasonic wave to form the seal. The working mode of this power supply is as follows: a carbon film is arranged on the circuit board 4, a conductive film is arranged on the end face of the conductive button 3, and if the conductive button 3 is pressed, the conductive film on the conductive button 3 is in contact with the carbon film on the circuit board 4, so that a pulse signal is generated to the circuit board (one pulse signal is generated for each pressing), a processor on the circuit board 4 can output a corresponding control signal to control a load after receiving the pulse signal, and then the load emits lights with different effects.

However, for the conductive button, a hole needs to be formed in the upper cover 1 and is used for assembling the conductive button. After the assembly is finished, the conductive button 3 needs to be exposed outside, and if no pressure exists between the conductive button 3 and the mounting hole of the upper cover 1 and between the conductive button 3 and the circuit button 4, clearances will generate, wherein the clearances need to be eliminated, and if the clearance is not eliminated, liquid will enter the shell through the clearances and certainly will cause a problem that the circuit board 4 is burnt out due to short circuit. Currently, the clearances are eliminated by the following methods: when the circuit board is assembled, the circuit board 4 and the conductive button 3 are fit tightly, and the conductive button 3 generates an action force to the circuit board 4, so that the circuit board 4 generates a certain deformation; conversely, the circuit board 4 generates a supporting force to the conductive button 3, so that the conductive button 3 generates displacement towards the outer side of the upper cover 1 in the axial direction of the mounting hole, and the outer circumference of the conductive button 3 fills full of the clearance between the conductive button and the mounting hole. Therefore, the clearance between the conductive button 3 and the circuit board 4 is eliminated, and the clearance between the conductive button 3 and the mounting hole is also eliminated. Although the waterproof problem of the conductive button of the LED power supply with the horizontal structure is solved, the LED power supply with the horizontal structure still has the following problems:

the upper cover 1 and the lower cover 2 are made from a PC material, the output waterproof socket 5 is made from a PVC material, and the upper cover 1, the lower cover 2 and the output waterproof socket 5 are assembled and then are welded by the ultrasonic wave. In theory, they are sealed, and if the sizes of all components are matched, the power supply can also be waterproof. Actually, the components made from different materials cannot be fused, and during production, various small problems will cause the contact part of the PVC material and the PC material to generate a gap, so that the power supply cannot be waterproof. Furthermore, for batch products, the problems are hard to be controlled.

Currently, an LED vertical power supply occurs on the market. As shown in the FIG. 3 and the FIG. 4, the LED vertical power supply comprises a shell 1 a first circuit board 2, a second circuit board 3, a tail cover 4, a conductive button 5 and an output waterproof socket 6. The shell 1 is formed in an integrated mode. One end of the shell 1 is closed and the other end is provided with an opening. A conductive insertion sheet is fixed at the closed end of the shell 1. The first circuit board 2 is mounted in the shell 1 in parallel with the axial direction of the shell 1, the second circuit board 3 is mounted in a cavity of the tail cover 4, the arrangement direction of the second circuit board 3 is mutually vertical to the axial direction of the shell 1, the first circuit board 2 and the second circuit board 3 are welded by conductors to perform electric signal transmission, a carbon film is arranged on the second circuit board 3, a mounting hole is formed in the tail cover 4, one end of the conductive button 5 penetrates through the mounting hole of the tail cover 4, and a conductive film is arranged on the other end of the conductive button 5. One end, on which the conductive film is arranged, of the conductive button 5 is positioned in the cavity of the tail cover and is fit on the second circuit board 3, and after the tail cover 4 and the shell 1 are closed, the second circuit board 3 is mounted in the cavity of the tail cover 4 due to a supporting function of the first circuit board 2 or in an interference fit mode, so that the second circuit board 3 keeps a stable state. Additionally, the output waterproof socket 6 and the shell 1 are formed in the integrated mode. Although this LED vertical power supply solves the waterproof problem of the LED horizontal power supply, the following new problems generates.

Firstly, it can be known from the description of the LED vertical power supply: the conductive button 5 of the LED vertical power supply also needs a reverse action force of the second circuit board 5 to tightly fit with the second circuit board 3 and to eliminate the clearance between the conductive button 5 and the mounting hole of the tail cover 4. However, in use, the conductive button 5 needs to be pressed, the pressing force is transferred from the conductive button 5 to the second circuit board 3 in the pressing process, and the second circuit board 3 is mounted in the cavity of the tail cover 4 due to the supporting function of the first circuit board 2 or in the interference fit mode, thereby certainly causing deflecting or loosening of the second circuit board 3, and then a clearance not only generates between the conductive button 5 and the second circuit board 3, but also generates between the conductive button 5 and the mounting hole of the tail cover 4 under the condition that the conductive button 5 loses the reverse action force of the second circuit board 5. Therefore, the LED vertical power supply cannot be waterproof. Besides, the conductive button 5 needs to vertically and tightly fit the second circuit board 3, so that the conductive button 5 cannot be mounted on the shell like a mounting manner of the LED horizontal power supply; the specific reason is as follows: after the first circuit board 2 is inserted into the integrated shell 1, the first circuit board 2 and the conductive button 5 cannot generate a mutual action force like the LED horizontal power supply due to the limit of an assembly space, so that the clearances generate between the conductive button 5 and the first circuit board 2 and between the conductive button 5 and the shell 1.

Secondly, although the LED vertical power supply forms circuit control by utilizing the two circuit boards to solve the waterproof problem of the shell 1, the following problems still exist: assembly processes of the first circuit board 2, the second circuit board 3 and the conductive button 5 are complex, batch production efficiency is low, and production costs are high.

SUMMARY OF PRESENT INVENTION

To solve above-mentioned technical problems, the present utility model provides a vertical power supply for a lamp, having a simple structure and a great waterproof effect.

A technical scheme for solving the above-mentioned technical problems is as follows:

The vertical power for the lamp comprises a shell formed in an integrated mode and a tail cover, wherein one end of the shell is closed and the other end is provided with an opening; the tail cover is fixedly connected with the opening end of the shell; and a hole is formed in the tail cover. The vertical power supply for the lamp further comprises a circuit board with a control circuit, a switch for generating a pulse signal and a sealing piece, wherein at least one part of the circuit board is mounted in a cavity of the shell; one end of the switch is welded and fixed on the circuit board, and the other end of the switch is a free end; the sealing piece is mounted in the hole of the tail cover to seal the hole; and after the tail cover and the shell are fixed, the sealing piece abuts against the free end of the switch and one end of the sealing piece is exposed in the air.

Preferably, if a pressure is applied to the end, exposed in the air, of the sealing piece, the pressure is loaded to the switch, and the switch is on and then transmits a pulse signal to the control circuit of the circuit board.

Preferably, the free end of the switch extends in the hole of the tail cover to abut against the sealing piece.

Preferably, an included angle larger than 0 degree is formed between the axial direction of the free end of the switch and a connection point of the switch and the circuit board.

Preferably, the tail cover is a tail cover with a cavity, the free end of the switch is positioned in a cavity of the shell or the tail cover, and the sealing piece extends into the cavity of the shell or the tail cover to abut against the free end of the switch.

Preferably, an included angle larger than 0 degree is formed between the axial direction of the free end of the switch and a connection point of the switch and the circuit board.

Preferably, the switch comprises, an outer casing, a first conductive pin, a second conductive pin, a conductive sheet and a press rod; an accommodating cavity is formed in the outer casing, one end of the first conductive pin and one end of the second conductive pin are exposed out of the outer casing, a part of the first conductive pin and a part of the second conductive pin are positioned in the accommodating cavity of the outer casing, one end of the conductive sheet is supported on the first conductive pin, the other end of the conductive sheet is connected with or abuts against one end of the press rod, and the other end of the press rod is positioned out of the outer casing; and if a pressure is applied to the press rod, the conductive sheet generates deformation to be in contact with the second conductive pin, and the first conductive pin and the second conductive pin are conducted to generate a pulse signal.

Preferably, a connecting sheet is at least arranged on the outer wall surface of the outer casing, and the connecting sheet is fixedly connected with the circuit board.

Preferably, the first conductive pin comprises a first conductive body, a first connecting body and a second connecting body; one end of the first connecting body and one end of the second connecting body are connected with the first conductive body, and the other end of the first connecting body and the other end of the second connecting body extend towards the second conductive pin; the conductive sheet is supported on the first connecting body and the second connecting body; and the second conductive pin comprises a second conductive body and a third connecting body; one end of the third connecting body is connected with the second conductive body, and the other end of the third connecting body extends towards the first conductive pin.

Preferably, the conductive sheet at least comprises a spherical first conductive sheet.

More preferably, the conductive sheet further comprises an annular second conductive sheet, and one end of the first conductive sheet is fixedly connected with one end of the second conductive sheet.

Preferably, the switch comprises an outer casing, a first conductive pin, a second conductive pin, a spring, a conductive sheet and a press rod; an accommodating cavity is formed in the outer casing, one end of the first conductive pin and one end of the second conductive pin are exposed out of the outer casing, a part of the first conductive pin and a part of the second conductive pin are positioned in the accommodating cavity of the outer casing, one end of the conductive sheet is supported on the first conductive pin, one end of the spring abuts against or is fixed on the bottom, wall of the interior of the outer casing, the other end of the spring is connected with the conductive sheet, the other end of the conductive sheet is connected with or abuts against one end of the press rod, the other end of the press rod is positioned out of the outer casing, and the conductive sheet is positioned between the first conductive pin and the second conductive pin.

Preferably, the sealing piece comprises a cylindrical main body; one end of the main body is closed, and the other end of the main body is provided with an opening; a first flange is arranged on one end of the main body, and a second flange is arranged at the other end of the main body; a non-closed annular groove is formed among the first flange, the second flange and the main body; the hole wall of the tail cover is embedded into the annular groove, so that the sealing piece is clamped on the tail cover; and the first flange is exposed in the air.

Preferably, a control circuit of the circuit board comprises a direct-current power supply, a control module and a bridge driving circuit connected with an output end of the control module; the control module transmits a control signal according to the pulse signal provided by the switch; the bridge driving circuit, according to the control signal provided by the control module, converts direct current input to the bridge driving circuit into accurately-controlled non-sine alternating current to output; and the direct-current power supply is provided with a high-level output end directly provided for a load, and the high-level output end, a first output end of the bridge driving circuit and a second output end of the bridge driving circuit form an output end of the control circuit together.

Preferably, a control circuit of the circuit board comprises a direct-current power supply and a control module; the control module transmits a control signal according to the pulse signal provided by the switch, and the control signal converts direct current input to the control module into accurately-controlled non-sine alternating current to output; and the direct-current power supply is provided with a high-level output end directly provided for a load, and the high-level output end, a first output end of the control module and a second output end of the control module form an output end of the control circuit together.

The vertical power for the lamp has the advantages that: the circuit board is vertically mounted, and only one circuit board is arranged on the vertical power supply, so that an included angle is formed between the axial direction of the free end of the switch and the connection point of the switch and the circuit board when the switch is fixed on the circuit board in a welding manner; the sealing piece simultaneously independently seals the hole opened in the tail cover, and additionally, the free end of the switch and the sealing piece are abutted against with each other, so that the sealing piece is reliably supported on the tail cover; therefore, the switch and the circuit board do not need to keep under the pressure and an be sealed and waterproof, and the switch can be subjected to a pressing operation. Furthermore, in assembly, as long as the sizes of the sealing piece, the hole of the tail cover and the switch are up to the designed requirements, the three components can be assembled through simple mounting steps, and the assembly precision of the three components do not need to be considered carefully. Therefore, after the vertical power supply utilizes one vertically mounted circuit board, the number of needed components is reduced, so that the structure of the vertical driving circuit is simplified; additionally, due to a newly designed structure, the vertical power supply solves the waterproof problem; besides, effects of simplifying the technique, reducing the processing costs and improving the production efficiency are realized.

The vertical power supply provided by the present utility model does not limit to driving LED lamps, and can be also used for driving desk lamps, acryl lamps, lamps on the furniture and the like, thereby having the characteristic of wide application.

Figure 1:
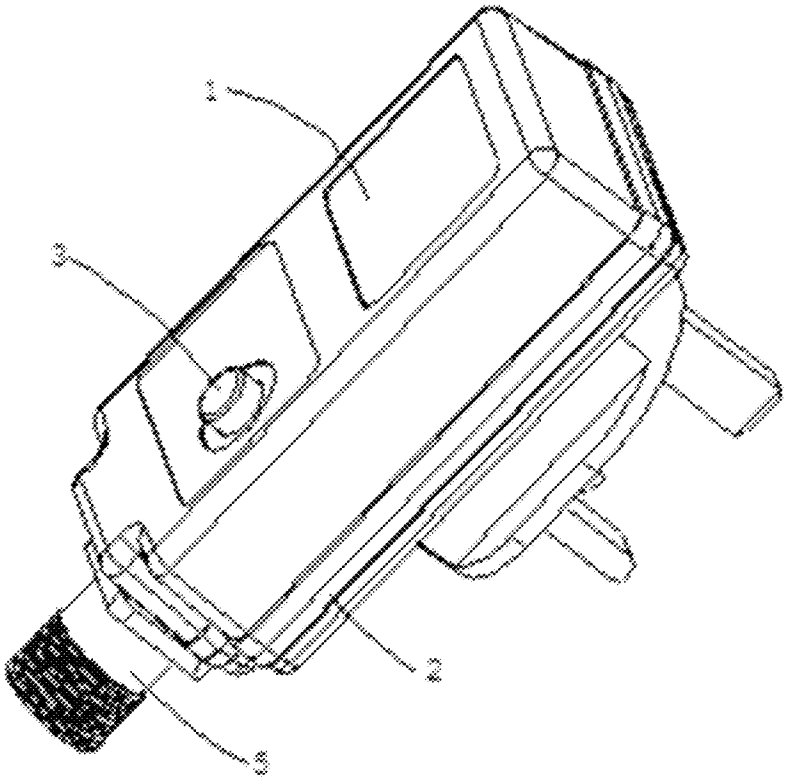
FIG. 1 is a current LED horizontal power supply.
Figure 2:
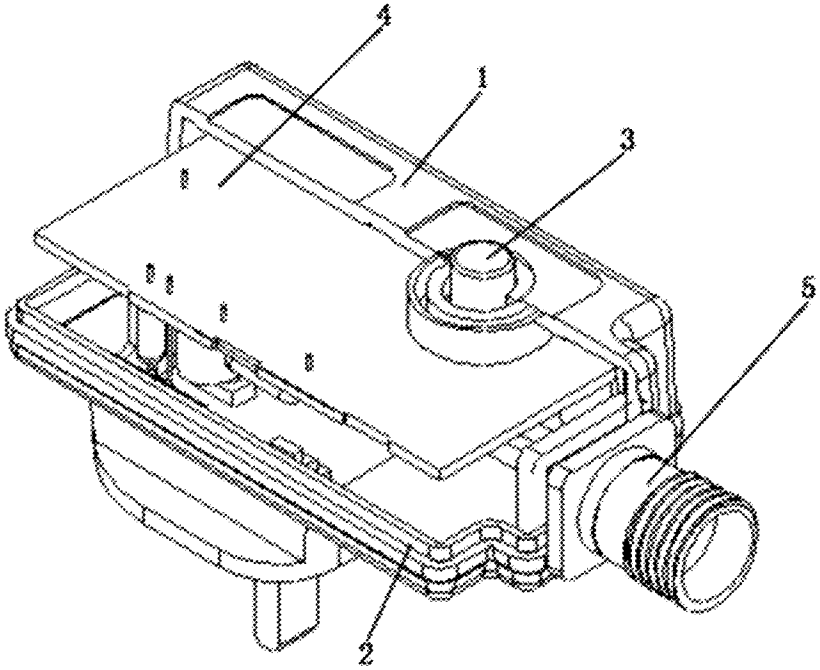
FIG. 2 is a schematic diagram after a part of an upper cover is removed in the FIG. 1.
Figure 3:
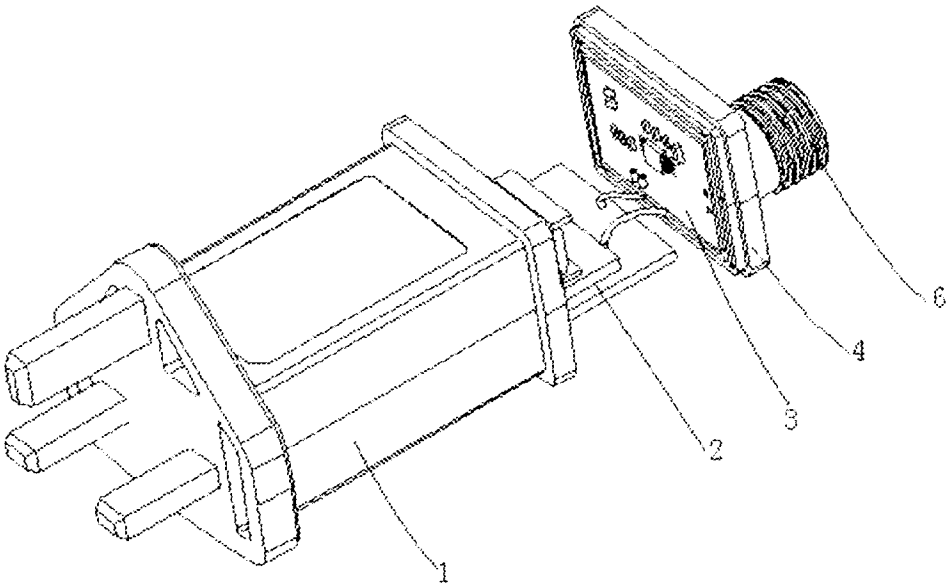
FIG. 3 is a current LED vertical power supply.
Figure 4:
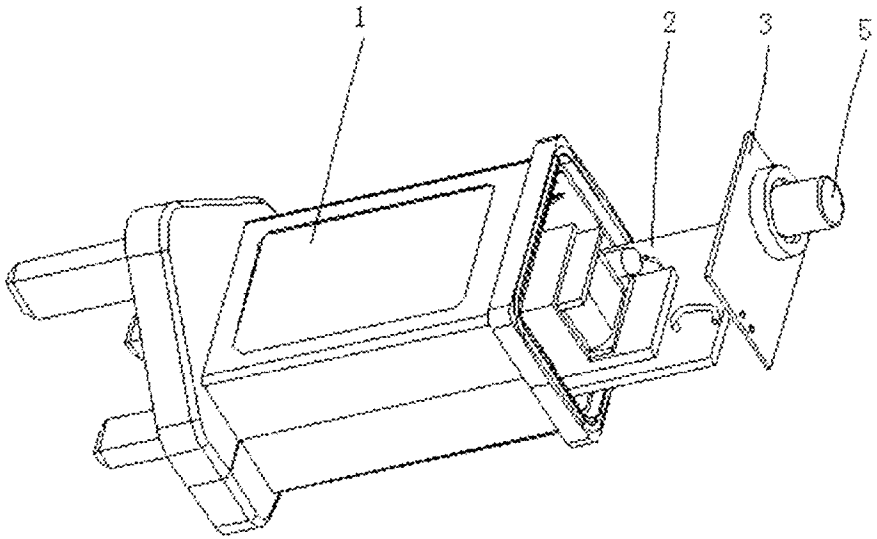
FIG. 4 is a schematic diagram after a tail cover is hidden in the FIG. 3.

In the accompanying drawings, the following are shown:

Shell 1;

Tail cover 2 and waterproof socket 2*a;*

Circuit board 3;

Switch 4, outer casing 40, connecting sheet 40*a,* first conductive pin 41, first conductive body 41*b,* second connecting body 41*c,* boss 41*d,* second conductive pin 42, second conductive body 42*a,* third connecting body 42*b,* protrusion part 42*c,* conductive sheet 43, first conductive sheet 43*a,* second conductive sheet 43*b,* and press rod 44;

Sealing piece 5, main body 50, first flange 51, second flange 52, hole 53, annular groove 54, and inner top wall surface 55;

Switch 6, outer casing 60, first conductive pin 61, second conductive pin 62, conductive sheet 63, press rod 64, spring 65, protrusion part 66, and sleeve 67;

Sealing piece 7, main body 70, first flange 71, second flange 72, ejector rod 73, annular groove 74, inner top wall surface 55, and groove 76.

DETAILED DESCRIPTION OF PREFERRED EMBODIMENTS

The following further describes the present utility model in details with reference to the accompanying drawings and the embodiments.

Figure 5:
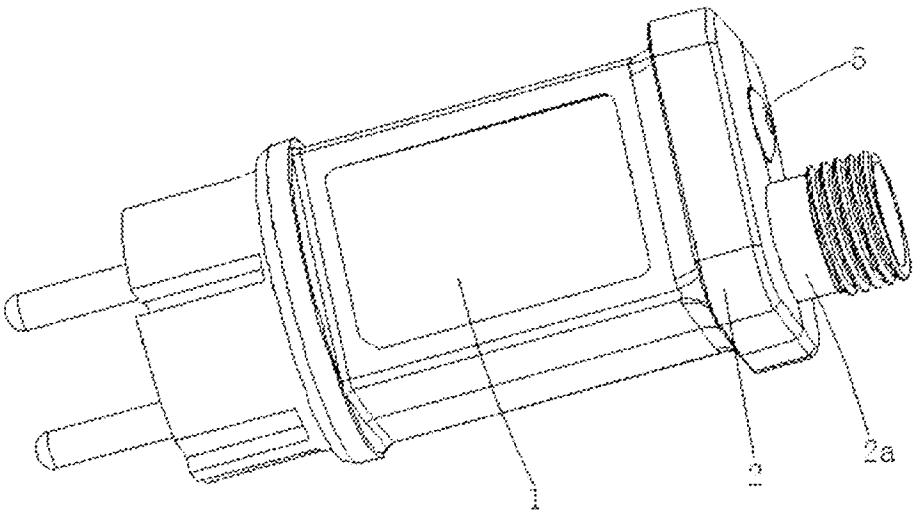
FIG. 5 is an appearance schematic diagram of a vertical power supply provided by the present utility model.
Figure 6:
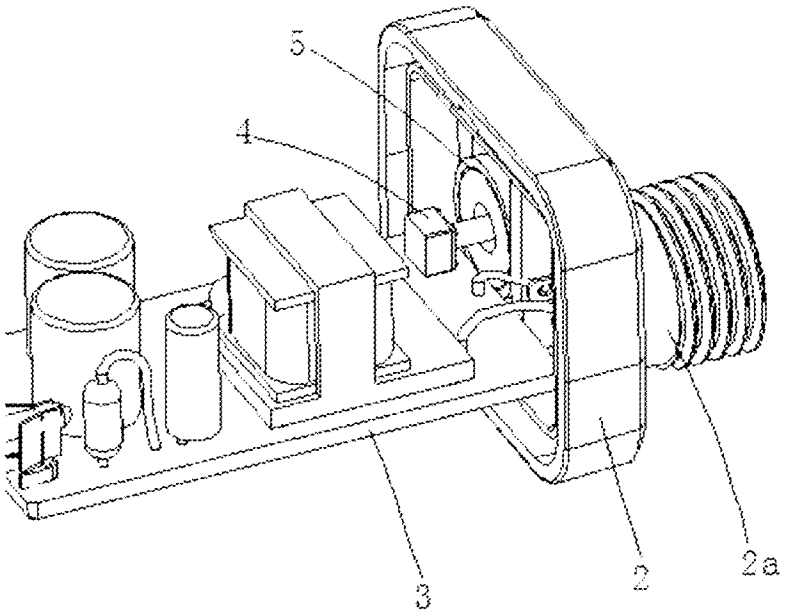
FIG. 6 is a schematic diagram after a shell is hidden in the FIG. 5.

As shown in the FIG. 5 and the FIG. 6, a vertical power supply for a lamp, which is provided by the present utility model, comprises a shell 1 formed in an integrated mode, a tail cover 2, one circuit board 3 with a control circuit, a switch 4 for generating a pulse signal and a sealing piece 5. The following describes each component and correlations of the components in details.

As shown in the FIG. 5 and the FIG. 6, one end of the shell 1 is closed and the other end is provided with an opening; the tail cover 2 is fixedly connected with the opening end of the shell 1; the tail cover 2 and the shell 1 are manufactured by utilizing the same material (such as a PC or PVC material), the tail cover 2 and the shell 1 are welded by utilizing ultrasonic waves in order to enable the both to be fused greatly, and, to improve the reliability of seal between the shell 1 and the tail cover 2, a sealing ring is also arranged between the shell 1 and the tail cover 2. A hole is formed in the tail cover 2, the axial direction of the hole and the axial direction of the shell 1 are in parallel. An output waterproof socket 2*a* is arranged on the tail cover 2, the output waterproof socket 2*a* and the tail cover 2 are formed in the integrated mode, and one end of a conductive output part of the output waterproof socket 2*a* is fixed on the inner wall surface of the tail cover 2 by utilizing a riveting manner. The tail cover 2 can adopt a cover cap type (namely having a corresponding cavity) structure, and can also adopt a thin-plate type structure, and in the embodiment, the tail cover 2 preferably adopts the cover cap type structure.

As shown in the FIG. 5 and the FIG. 6, at least one part of the circuit board 3 is mounted in a cavity of the shell 1. Two long stripped blocks are respectively arranged on two opposite side wall surfaces of the cavity of the shell 1 at an interval so as to form a slot there between, and the two sides of the circuit board 3 are respectively embedded into the slots of the side wall surfaces of the shell 1 when the circuit board 3 and the shell 1 are mounted, so that the circuit board 3 is assembled in the axial direction of the shell 1, that is, the circuit board 3 is vertically mounted in the shell 1. In the embodiment, only a part of the circuit board 3 is assembled in the shell 1, the other part of the circuit board 3 is exposed out of the shell 1, and the cover cap type tail cover 2 covers the part of the circuit board 3 exposed out of the shell 1.

Figure 7:
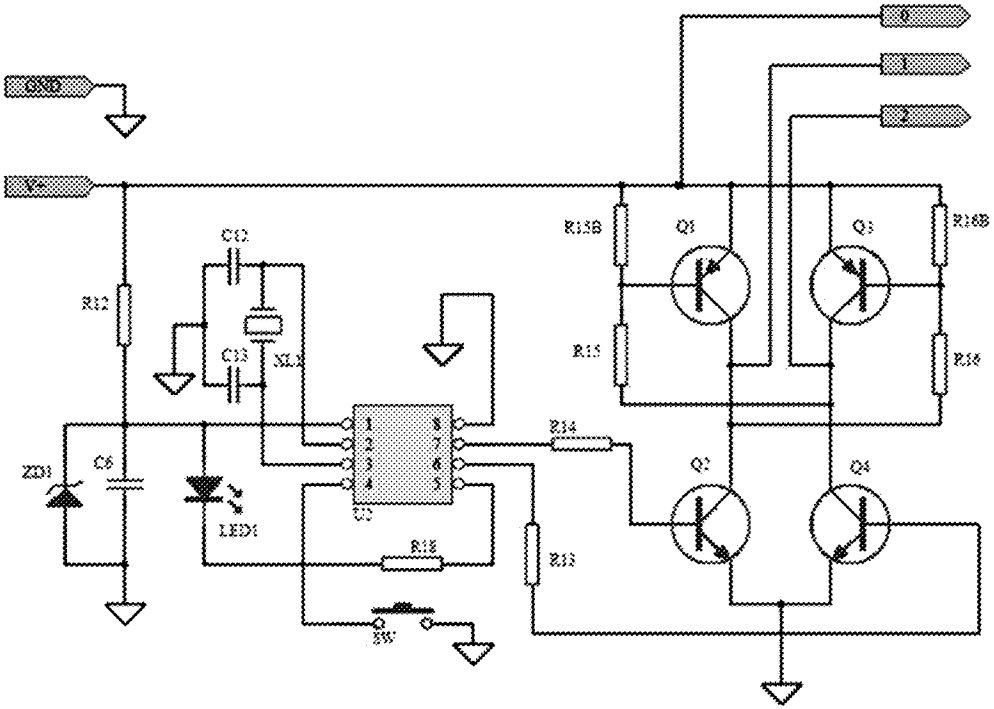
FIG. 7 is a schematic diagram of a first control circuit provided by the present utility model.

As shown in the FIG. 6 and the FIG. 7, the circuit board 3 is a circuit board with a control circuit. Preferably, the control board of the circuit board comprises a direct-current power supply V+, a control module U2 and a bridge driving circuit. The direct-current power supply V+ provides needed voltage for another circuit module, and the direct-current power supply V+ is provided with a high-level output end (corresponding to a No. 0 output line in the FIG. 7) directly provided for a load. The control module U2 is a microcontroller. The control module U2 transmits a control signal according to the pulse signal provided by the switch so as to change a lighting effect of the load. The lighting effect of the load provided by the present utility model is the same as the lighting effect provided by the utility model with the publication number of CN203523098U, and additionally, based on the lighting effect provided by the utility model with the publication number of CN203523098U, a lighting mode can be added or modified. The bridge driving circuit is connected with an output end of the control module U2, and according, to the control signal provided by the control module U2, the bridge driving circuit converts direct current input to the bridge driving circuit into accurately-controlled non-sine alternating current to output. The bridge driving circuit comprises a first triode Q1, a second triode Q2, a third triode Q3, a fourth triode Q4, a first resistor R15, a second resistor R15B, a third resistor R16 and a fourth resistor R16B; a base of the first triode Q1 is connected with a collector of the fourth triode Q4 through the first resistor R15, the base of the first triode Q1 is connected with the output end of the direct-current power supply through the second resistor R15B, a collector of the first triode Q1 is a first output end (corresponding to a No. 1 output line in the FIG. 7) of the bridge driving circuit, a base of the fourth triode Q4 is connected with the output end of the control module U2 through a resistor R13, the output end of the control module U2 is a pin 6 of the microcontroller U2, and an emitter of the fourth triode Q4 is grounded. A base of the third triode Q3 is connected with a collector of the second triode Q2 through the third resistor R16, the base of the third triode Q3 is connected with the output end of the direct-current power supply through a fourth resistor R16B, and the collector of the third triode Q3 is a second output end (corresponding to a No. 2 output line in the FIG. 7) of the bridge driving circuit. A base of the second triode Q3 is connected with the output end of the control module U2 through a resistor R14, and an emitter of the second triode Q2 is grounded. An emitter of the first triode Q1 and an emitter of the third triode Q3 are connected, the collector of the first triode Q1 and the collector of the second triode Q2 are connected, and the collector of the third triode Q3 and a collector of the fourth triode Q4 are connected. The high-level output end (corresponding to the No. 0 output line in the FIG. 7) of the direct-current power supply V+ forms an output end of the control circuit with the first output end (corresponding to a No. 1 output line in the FIG. 7) and the second output end (corresponding to a No. 2 output line in the FIG. 7) of the bridge driving circuit.

Figure 8:
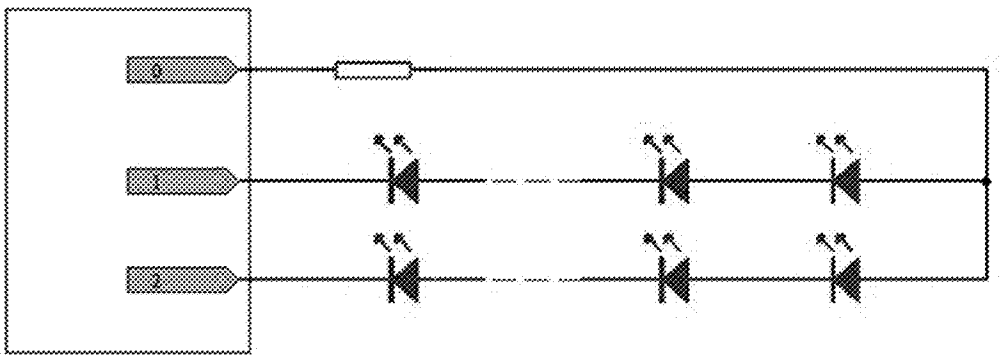
FIG. 8 is a connection schematic diagram LED strips of a load and an output end of the control circuit.

As shown in the FIG. 8, the load provided by the present utility model comprises two LED strips, wherein one end of a first LED strip is connected with the high-level output end (corresponding to the No. 0 output line in the FIG. 7) of the direct-current power supply V+, and the other end of the first LED strip is connected with the first output end (corresponding to the No. 1 output line in the FIG. 7) of the bridge driving circuit; one end of the second LED strip is connected with the high-level output end (corresponding to the No. 0 output line in the FIG. 7) of the direct-current power supply, and the other end of the second LED strip is connected with a second output end (corresponding to the No. 2 output line in the FIG. 7) of the bridge driving circuit. Connection of the control of the control circuit and the two LED strips has the advantages: when the first output end is low level and the second output end is high level, the first LED strip is turned on; when the second output end is low level and the first output end is high level, the second LED strip is turned on; when the first output end and the second output end are low level, the first LED strip and the second LED strip are turned on. Compared with embodiments provided by the utility model with the publication number of CN203523098U, the embodiments provided by the present utility model have the advantages: besides one of the two LED strips is turned on, the two LED strips can be turned on at the same time, but in the embodiments provided by the utility model with the publication number of CN203523098U, only one of the two LED strips can be turned on. Furthermore, the control module U2 in the embodiment has a timing function; when the switch 4 (corresponding to SW in the circuit diagram) is long-pressed for three seconds, the power supply starts a timing working mode and starts to time, the power supply is turned off after six hours (or eight hours), the power supply restarts to work after 18 hours (or 16 hours), and such cycle repeats. An LED 1 is a timing indication light and is turned on after the power supply starts the timing working mode.

The working steps of this part are as follows:

Step 1: when starting up, the power supply can recover o a working state in close down;

Step 2: after starting up, the direct-current power supply provides direct-current voltage to the control circuit and supplies power to the control module U2 through a resistor R12;

Step 3: the control module U2 is powered on and starts working and a sixth pin and a seventh pin of the control module U2 output two control signals to the bridge driving circuit; by the switch 4 (corresponding to SW on the circuit diagram), the working states of the output signals of the sixth pin and the seventh pin of the control module U2 can be randomly changed, so that various variable lighting effects of the LED strips can be realized.

Step 4: according to the control signal provided by the control module U2, the bridge driving circuit converts direct current input to the bridge driving circuit into accurately-controlled non-sine alternating current to output to the LED strips of the load; under the control of the control module U2, the first LED strip or the second LED strip is turned on, or the first LED strip and the second LED strip are turned on at the same time.

As shown in the FIG. 5 and the FIG. 6, one end of the switch 4 is welded and fixed on the circuit board 3, and the other end of the switch 4 is a free end. The switch 4 and the circuit board 3 utilize a welding assembly mode, the following advantages are provided: based on the above-mentioned assembly mode of the circuit board 3 and the shell 1, if the circuit board 3 extends in the shell 1, they form a clearance fit relation, and, the assembly structure of the circuit board 3 and the shell 1 with the clearance fit relation has the waterproof problem after the conductive button and the switch are assembled like the horizontal power supply and the vertical power supply in the background; however, in the present utility model, the switch 4 and the circuit board 3 are fixed by the welding manner, and due to this fixing relation and the self-structure of the switch 4, an included angle larger than 0 degree, preferably 90 degrees, is formed between the axial direction of the free end of the switch 4 and the connecting point of the switch 4 and the circuit board 3; therefore, an assembly problem of the switch and the circuit board (the pressure does not need to exist between the switch 4 and the circuit board 3) by utilizing one circuit board in the vertical power supply is solved, the sealing of the switch 4 is greatly facilitated, and the pressure is very convenient to be applied to the switch in use.

Figure 9:
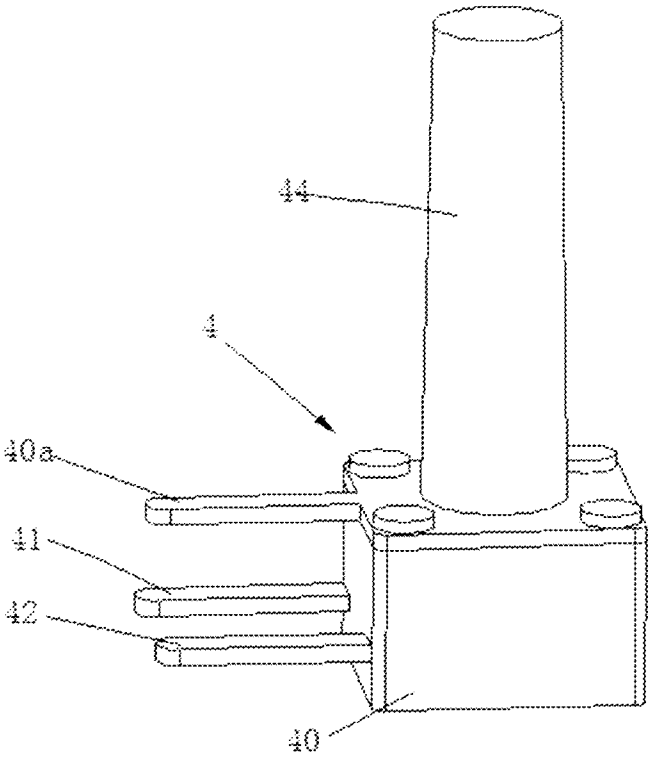
FIG. 9 is an appearance schematic diagram of a first switch provided by the present utility model.
Figure 11:
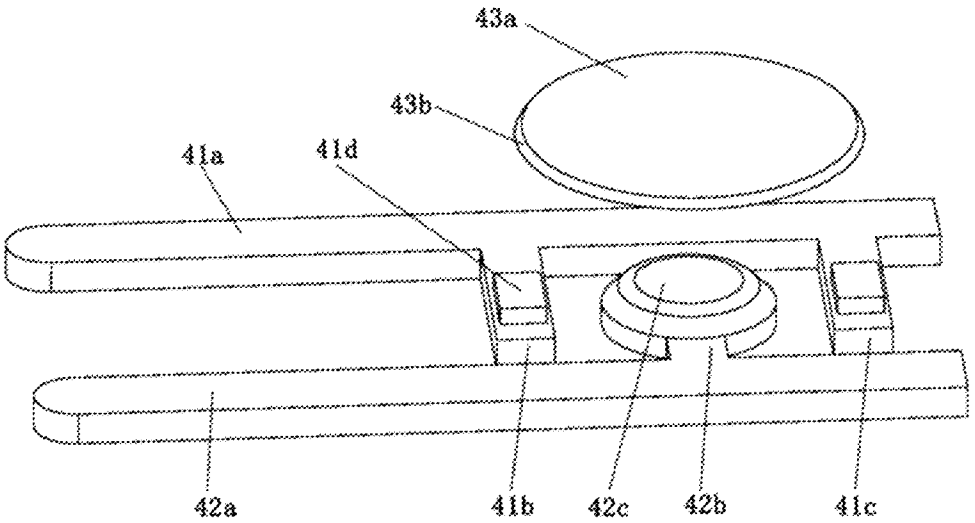
FIG. 11 is an exploded view of a first pin, a second pin and a conductive sheet of the switch in the FIG. 9.

As shown in the FIG. 9 to the FIG. 11, the switch provided by the present utility model prefers to the following implementation structure: the switch 4 comprises an outer casing 40, a first conductive pin 41, a second conductive pin 42, a conductive sheet 43 and a press rod 44; an accommodating cavity is formed in the outer casing 40; the outer casing 40 is made of a nonconductive material, such as plastic or rubber; the outer casing 40 consists of a casing with the accommodating cavity and a cover plate, the cover plate is fastened with the casing by utilizing an adhesion or bolt connection manner in the integrated mode after covering the cavity opening of the casing, a through hole is formed in the cover plate, and the free end of the switch penetrates through the through hole. A connecting sheet 40*a* is at least arranged on the outer wall surface of the outer casing 40, and the connecting sheet 40*a* is fixedly connected with the circuit board 3. In the embodiment, the connecting sheet 40*a* is arranged on the cover plate (or on the casing) and extends in the radial direction of the cover plate, the connection part of the connecting sheet 40*a* and the circuit board 3 is positioned on the upstream of the welding part of the first conductive pin 41 and the circuit board 3 and the welding part of the second conductive pin 42 and the circuit board 3. Due to the fixing connection of the connecting sheet 40*a* and the circuit board, not only the firmness, but also the bearing capacity of the connection of the switch 4 and the circuit board 3 are improved. Furthermore, when a user applies the pressure to the switch 4, the pressure is bore by the connection part of the connecting sheet 40*a* and the circuit board 3, thereby preventing a situation that the welding part of the first conductive pin 41 and the circuit board 3 and the welding part of the second conductive pin 42 and the circuit board 3 are broken due to the fact that the pressure is transferred to the two welding parts.

Figure 10:
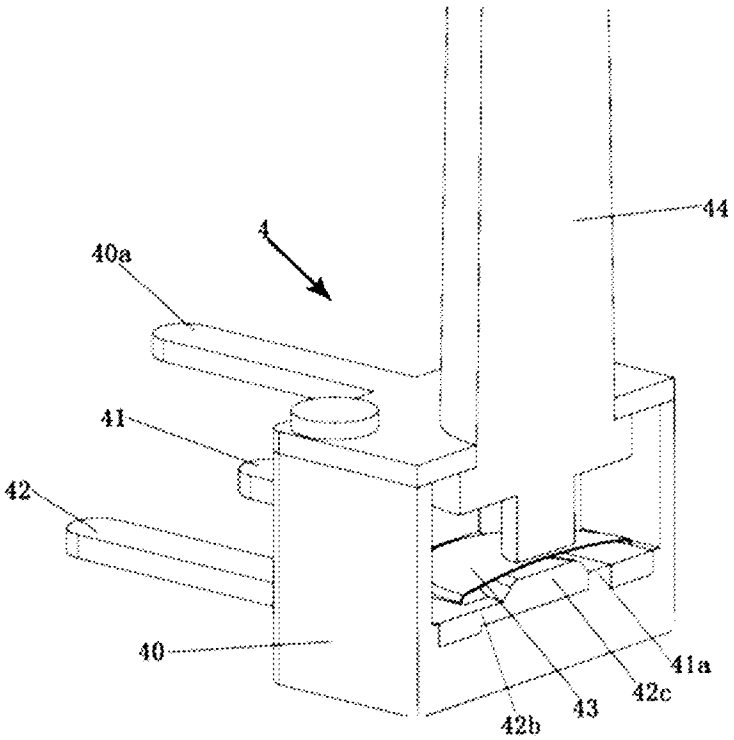
FIG. 10 is a schematic diagram after a part of the switch is sectioned off in the FIG. 9.

As shown in the FIG. 10 and the FIG. 11, one end of the first conductive pin 41 and one end of the second conductive pin 42 are exposed out of the outer casing 40, a part of the first conductive pin 41 and a part of the second conductive pin 42 are positioned in the accommodating cavity of the outer casing 40, and the other end of the first conductive pin 41 and the other end of the second conductive pin 42 are fixed on the side wall surface of the outer casing. The first conductive pin 41 comprises a first conductive body 41*a*, a first connecting body 41*b* and a second connecting body 41*c*, one end of the first connecting body 41*b* and one end of the second connecting body 41*c* are connected with the first conductive body 41*a*, the other end of the first connecting body 41*b* and the other end of the second connecting body 41*c* extend towards the second conductive pin 42, and the conductive sheet 43 is supported on the first connecting body and the second conductive body; preferably, one end of the first connecting body 41*b* and one end of the second connecting body 41*c* are connected with a side wall surface, opposite to the second conductive body 42, of the first conductive body 41*a*; bosses 41*d* are respectively arranged on the first connecting body 41*b* and the second connecting body 41*c*, and the conductive sheet 43 is supported on the bosses 41*d*.

As shown in the FIG. 10 and the FIG. 11, the second conductive pin 42 comprises a second conductive body 42*a* and a third connecting body 42*b*, one end of the third connecting body 42*b* is connected with the second conductive body 42*a*, and the other end of the third connecting body 42*b* extends towards the, first conductive pin 41. Preferably, the third connecting body 42*b* is connected with a side wall surface, opposite to the first conductive body 41*a*, of the second conductive body 42*a*. Therefore, the third connecting body 42*b* can be arranged between the first connecting body 41*b* and the second connecting body 41*c*, and a protrusion part 42*c* can be arranged on the third connecting body 42*b*; when the pressure is applied to the press rod 44, the protrusion part 42*c* is in contact with the conductive sheet 43; to enlarge the contact area between the protrusion part 42*c* and the conductive sheet 43, preferably the protrusion part 42*c* is cylindrical.

As shown in the FIG. 10 and the FIG. 11, one end of the conductive sheet 43 is supported on the first conductive pin 41, and the other end of the conductive sheet 43 is connected with or abuts against one end of the press rod 44. The conductive sheet 43 at least comprises a spherical first conductive sheet 43*a*, and the first conductive sheet 43*a* with the spherical shape has an arch part corresponding to the protrusion part 42*c* of the second conductive pin 43, so that an interval exists between the first conductive sheet 43*a* and the protrusion part 42*c*. More importantly, this spherical shape is easy to deform under pressure, the deformed conductive sheet 43 is in contact with the protrusion part 42*c*, and when the pressure is removed, this spherical shape is easy to recover to the original shape. Therefore, the conductive sheet 43 with the spherical shape can conveniently connect or disconnect an electric signal with the first conductive pin 41 and the second conductive pin 42. Preferably, the conductive sheet further comprises an annular second conductive sheet 43*b*, and one end of the first conductive sheet 43*a* is fixedly connected with one end of the second conductive sheet 43*b*; the second conductive sheet 43*b* can be in a circular ring shape or a conical ring shape, and in the embodiment, preferably the second conductive sheet 43*b* is in the conical ring shape. The conductive sheet 43 is supported on the bosses 41*d* through the second conductive sheet 43*b*, wherein the two bosses 41*d* supports the second conductive sheet 43*b* and the bosses 41*d* are strip-shaped so that the contact area of the bosses 41*d* and the second conductive sheet 43*b* is larger, and the second conductive sheet 43*b* can obtain more stable support.

The other end of the press rod 44 is positioned out of the outer casing 49, and the press rod 44 penetrates through the through hole of the cover plate of the outer casing, so that the other end of the press rod 44 is exposed out of the outer casing 44, which is the free end of the switch 4. The press rod 44 and the through hole of the cover plate are in clearance fit relation, so that the press rod 44 is convenient to perform axial movement corresponding to the outer casing 40.

The working process of this part is as follows: the pressure is applied to the press rod 44, the first conductive sheet 43*a* of the conductive sheet 43 generates deformation and is in contact with the protrusion part 42*c* on the second conductive pin 43, and because the second conductive sheet 43*b* is supported on the bosses 41*d*, the first conductive pin 41 and the second conductive pin 42 are connected to transmit a pulse signal to the control circuit of the circuit board; after the pressure is removed, the first conductive sheet 43*a* resets under an elastic recovery force and pushes the press rod 44 to the original position. Once pressing, once pulse signal is transmitted; the control circuit stores the amount of the pulse signals and transmits different control signals according to the amount of the pulse signals, resulting in changing the lighting effect.

Figure 12:
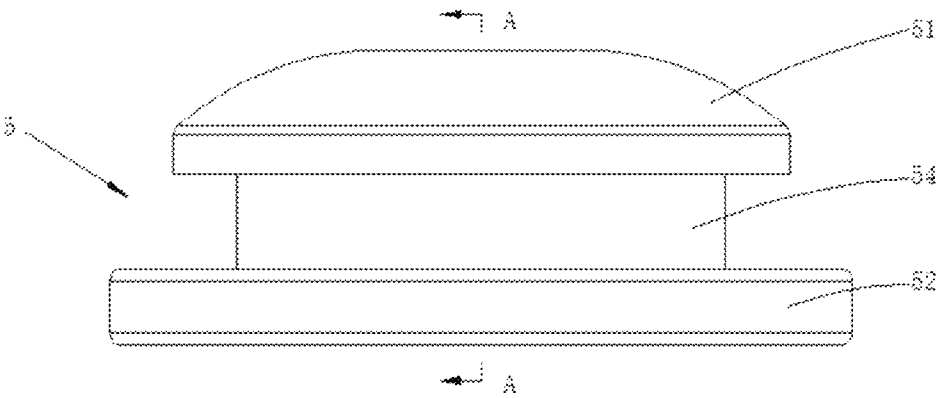
FIG. 12 is a schematic diagram of a first sealing piece provided by the present utility model.
Figure 13:
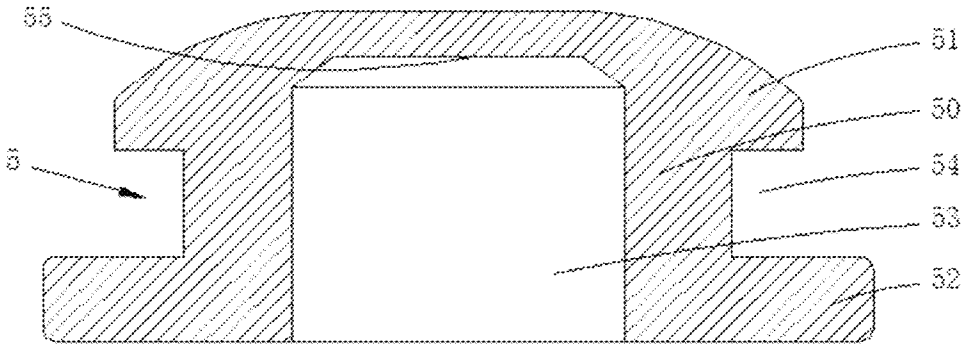
FIG. 13 is a sectional view along an A-A line in the FIG. 12.

As shown in the FIG. 5, the FIG. 6, the FIG. 12 and the FIG. 13, the sealing piece 5 is mounted in the hole of the tail cover 2 to seal the hole. After the tail cover 2 and the shell 1 are fixed, the sealing piece 5 abuts against the free end of the switch 4, and one end of the sealing piece 5 is exposed in the air. The sealing piece is made from the silica gel material preferably. The sealing piece 5 comprises a cylindrical main body 50, one end of the main body 50 is closed, and the other end of the main body 50 is provided with an opening; a first flange 51 is arranged on one end of the main body 50, and a second flange 52 is arranged on the other end of the main body 50; a non-closed annular groove 54 is formed among the first flange 51, the second flange 52 and the main body 50; the hole wall of the tail cover 2 is embedded into the annular groove, so that the sealing piece 5 is clamped on the tail cover 2; and the first flange 51 is exposed in the air. After the sealing piece 5 is clamped on the tail cove 2, the sealing piece 5 can seal the hole of the tail cover 2, and due to such clamping structure, the sealing piece 5 is stably assembled on the tail cover 2 and is not easy to remove. To facilitate the assembly of the sealing piece 5, the first flange 51 is set to be the spherical shape; due to such spherical shape, when the first flange 51 and the tail cover 2 are assembled, the spherical first flange 51 is easier to penetrate through the hole of the tail cover 2, and after exposed in the air, the first flange 51 becomes a pressure application point; moreover, an operator feels more comfortable when touching the first flange 51 with such spherical shape.

The free end of the switch 4 extends into the hole of the tail cover 2 and then abuts against the sealing piece 5. The sealing piece 5 is provide with a structure including the main body 50 and the first flange 51, so, obviously, the free end of the switch 4 abuts against the sealing piece 5 according to the following specific manner: the free end of the switch 4 extends into the hole of the main body 50 and abuts against the top wall surface 55 of the first flange 51; in use, the pressure is applied to the first flange 51, the pressure is transferred to the conductive sheet 43 through the press rod 44, so that the conductive sheet generates deformation, and the switch is on. For preventing the free end of the press rod 44 from breaking the first flange 51, the free end of the press rod 44 is spherical or arc, or a proof layer is arranged on the inner wall surface of the first flange 51.

Figure 14:
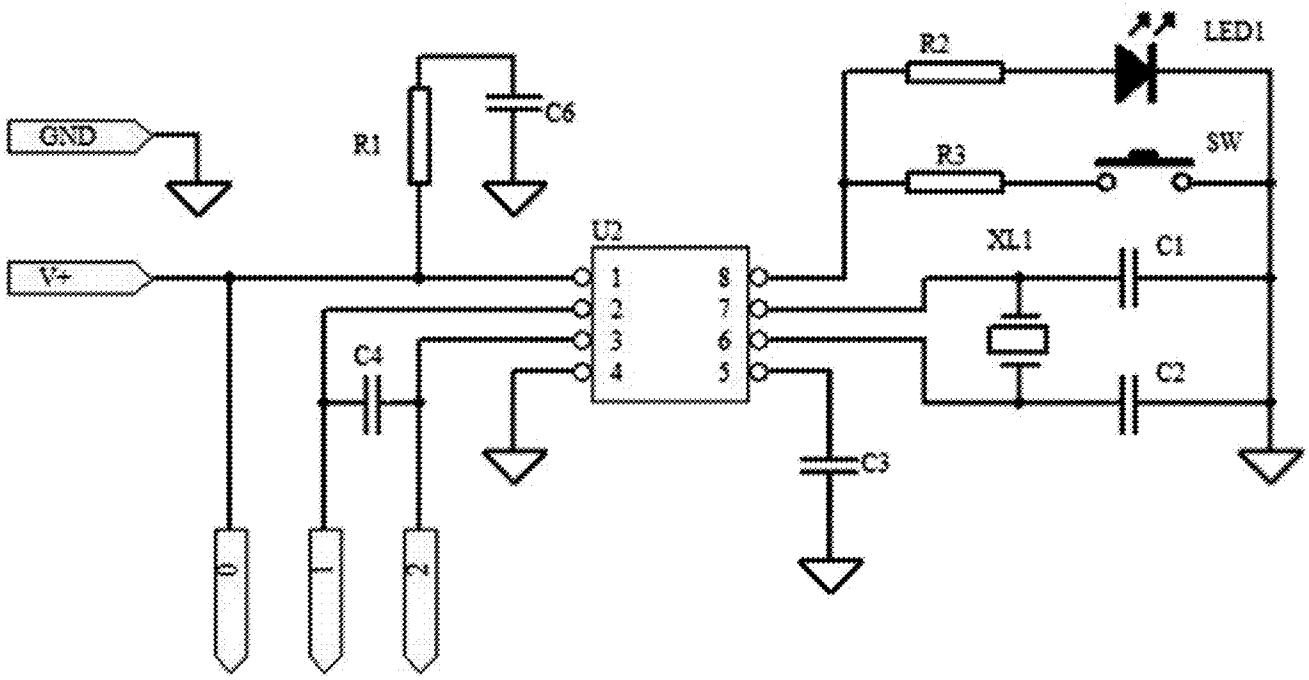
FIG. 14 is a schematic diagram of a second control circuit provided by the present utility model.

The control circuit provided by the present utility model does not limit to the above-mentioned embodiment. As shown in the FIG. 14, the control board on the circuit board comprises a direct-current power supply V+ and a control module U2, wherein the control module U2 transmits a control signal according the pulse signal provided by the switch and internally comprises a bridge driving circuit, so that the control signal is used for converting direct current input to the bridge driving circuit into accurately-controlled non-sine alternating current to output. The direct-current power supply V+ is provided with a high-level output end (corresponding to a No. 0 output line in the FIG. 14) directly provided for a load, the high-level output end forms an output end of the control circuit with a first output end (corresponding to a No. 1 output line in the FIG. 14) and a second output end (corresponding to a No. 2 output line in the FIG. 14) of the control module. The working steps of the control circuit are as follows:

Step 1: after starting up, the direct-current power supply provides direct-current voltage to the control module U2;

Step 2: the control module U2 is powered on and starts working, and a second pin and a third pin of the control module U2 output two control signals; by the switch 4 (corresponding to SW on the circuit diagram), the working states of the output signals of the second pin and the third pin of the control module U2 can be randomly changed, so that various variable lighting effects of the LED strips can be realized. Under the control of the control module U2, the first LED strip or the second LED strip is turned on, or the first LED strip and the second LED strip are turned on at the same time.

Compared with embodiments provided by the utility model with the publication number of CN203523098U, the embodiments provided by the present utility model have the advantages: besides one of the two LED strips is turned on, the two LED strips can be turned on at the same time, but in the embodiments provided by the utility model with the publication number of CN203523098U, only one of the two LED strips can be turned on. Furthermore, when the switch 4 (corresponding to SW in the circuit diagram) is long-pressed for three seconds, the power supply starts a timing working mode and starts to time, the power supply is turned off after six hours (or eight hours), the power supply restarts to work after 18 hours (or 16 hours), and such cycle repeats. An LED 1 is a timing indication light and is turned on after the power supply starts the timing working mode.

Figure 15:
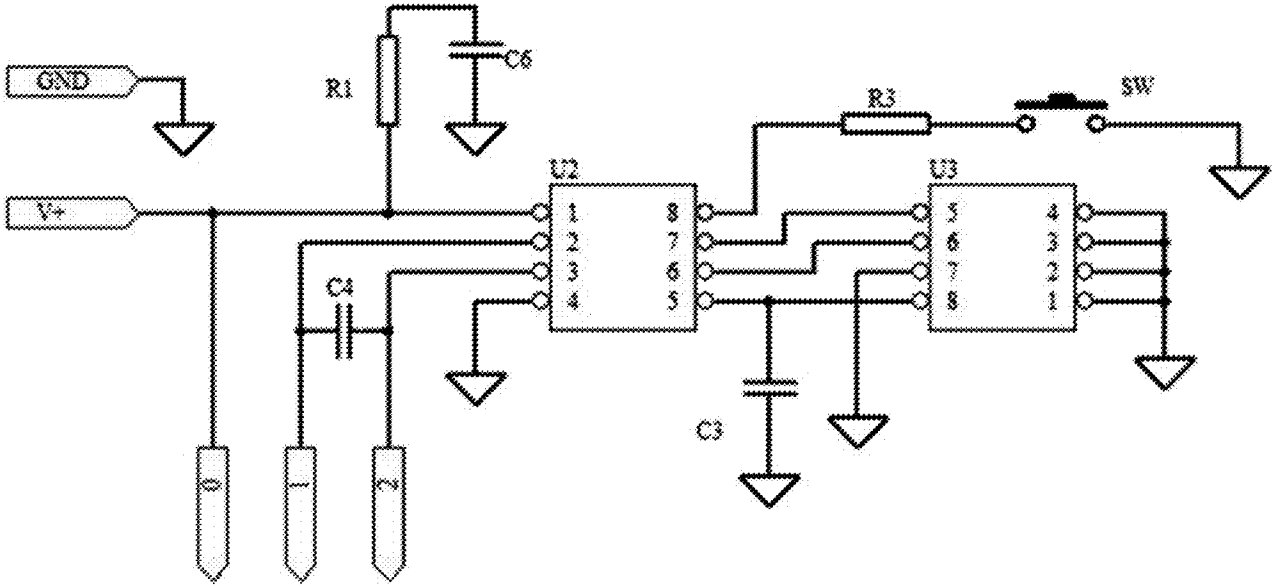
FIG. 15 is a schematic diagram of a third control circuit provided by the present utility model.

The control circuit provided by the present utility model does not limit to the above-mentioned embodiments. As shown in the FIG. 15, the control board on the circuit board comprises a direct-current power supply V+ and a control module U2, wherein the control module U2 transmits a control signal according the pulse signal provided by the switch; the control module U2 internally comprises a bridge driving circuit, so that the control signal is used for converting direct current input to the bridge driving circuit into accurately-controlled non-sine alternating current to output. The control circuit on the circuit board further comprises a storage module U3 used for realizing storage of load lighting effects, and the storage module U3 preferably utilizes a chip with the type of 24C02. The direct-current power supply V+ is provided with a high-level output end (corresponding to a No. 0 output line in the FIG. 15) directly provided for a load, the high-level output end forms an output end of the control circuit with a first output end (corresponding to a No. 1 output line in the FIG. 15) and a second output end (corresponding to a No. 2 output line in the FIG. 15) of the control module. The working steps of this control circuit are basically as same as the working steps of the control circuit shown in the FIG. 14, besides an added step of storing the load lighting effect.

Figure 16:
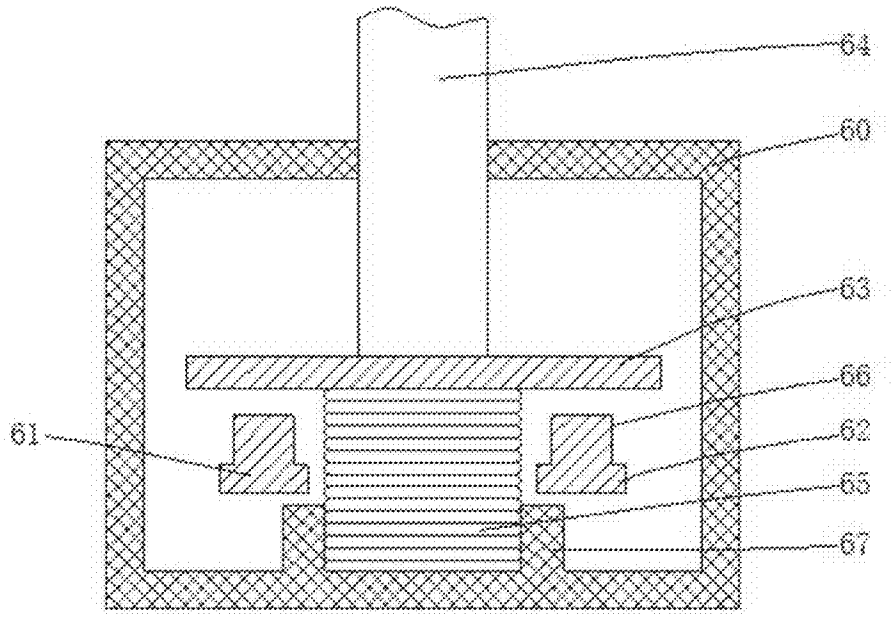
FIG. 16 is a section schematic diagram of a second switch provided by the present utility model.

The switch of the present utility model does not limit to the above-mentioned embodiments. As shown in the FIG. 16, the switch 6 comprises an outer casing 60, a first conductive pin 61, a second conductive pin 62, a conductive sheet 63, a press rod 64 and a spring 65; an accommodating cavity is formed in the outer casing 60; the outer casing 60 is made of a nonconductive material, such as plastic or rubber; the outer casing 60 consists of a casing with the accommodating cavity and a cover plate, the cover plate is fastened with the casing by utilizing an adhesion or bolt connection manner in the integrated mode after covering the cavity opening of the casing, a through hole is formed in the cover plate, and the free end of the switch penetrates through the through hole. A connecting sheet (which is not shown in the FIG.) is at least arranged on the outer wall surface of the outer casing 60, and the connecting sheet is fixedly connected with the circuit board 3. In the embodiment, the connecting sheet is arranged on the cover plate (or on the casing) and extends in the radial direction of the cover plate, the connection part of the connecting sheet and the circuit board is positioned on the upstream of the welding part of the first conductive pin and the circuit board and the welding part of the second conductive pin and the circuit board. Due to the fixing connection of the connecting sheet and the circuit board, not only the firmness, but also the bearing capacity of the connection of the switch and the circuit board are improved. Furthermore, when a user applies the pressure to the switch, the pressure is bore by the connection part of the connecting sheet and the circuit board, thereby preventing a situation that the welding part of the first conductive pin and the circuit board and the welding part of the second conductive pin and the circuit board are broken due to the fact that the pressure is transferred to the two welding parts.

One end of the first conductive pin 61 and one end of the second conductive pin 62 are exposed out of the outer casing 60, a part of the first conductive pin 61 and a part of the second conductive pin 62 are positioned in the accommodating cavity of the outer casing 60, and the other end of the first conductive pin 61 and the other end of the second conductive pin 62 are fixed on the side wall surface of the outer casing. The connection manner of the first conductive pin 61, the second conductive pin 62 and the circuit board 3 is consistent with the connection manner in the above-mentioned embodiments, that is, after the switch 6 is welded on the circuit board 3, an included angle larger than 0 degree, preferably 90 degrees, is formed between the axial direction of the free end of the switch 6 and the connecting point of the switch 6 and the circuit board 3; therefore, an assembly problem of the switch and the circuit board (the pressure does not need to exist between the switch 6 and the circuit board 3) by utilizing one circuit board in the vertical power supply is solved, the sealing of the switch 6 is greatly facilitated, and the pressure is very convenient to be applied to the switch in use. One end of the conductive sheet 63 is connected or in contact with one end of the spring 65, and the other end of the conductive sheet 63 is connected or in contact with the press rod 64; the conductive sheet 63 is positioned between the press rod 64 and the two conductive pins, and an interval exits between the conductive sheet 63 and the conductive pins, the other end of the spring abuts against or is connected with the bottom wall of the outer casing 60, and the whole spring 65 is positioned between the first conductive pin 61 and the second conductive pin 62, so that a supporting force to the conductive sheet 63 can be balanced by utilizing one spring. For shortening the pressing stroke of the press rod 64, protrusion parts 66 are respectively arranged on the first conductive pin 61 and the second conductive pin 62. When the pressure is applied to the press rod 64, the conductive sheet 63 generates displacement towards the positions of the conductive pins by following the press rod 64, and due to existence of the protrusion parts 66, the conductive sheet 63 can be firstly in contact with the protrusion parts 66, so that the first conductive pin 61 and the second conductive pin 62 are connected through the conductive sheet 63 to generate a pulse signal. Moreover, the spring 65 abuts against or is connected with the outer casing 69 in high reliability, a sleeve 67 is arranged at the bottom of the outer casing 60, and a part of the spring 65 is positioned in the sleeve.

Figure 17:
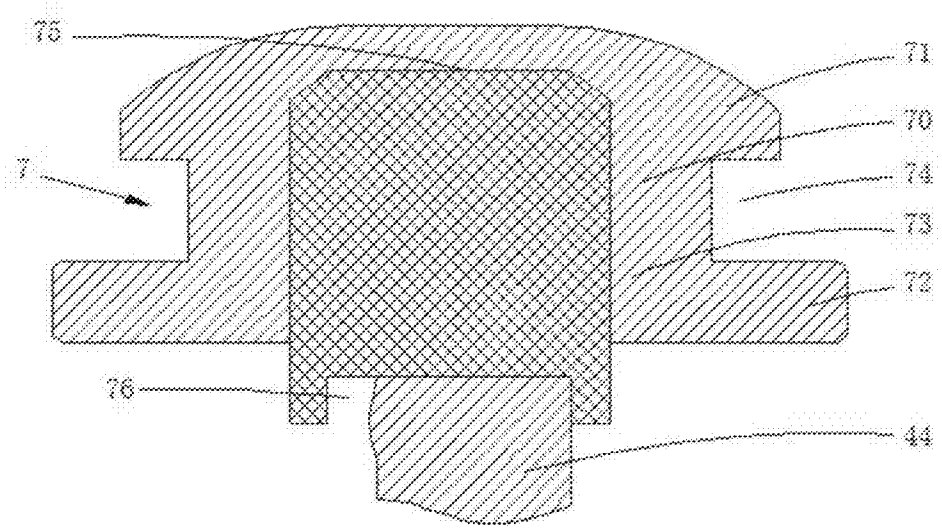
FIG. 17 is a schematic diagram of a second sealing piece provided by the present utility model.

The present utility model does not limit to the above-mentioned embodiments, wherein the tail cover is a tail cover with a cavity, the free end of the switch 4 is positioned in a cavity of the shell 1 or the tail cover 2, and the sealing piece extends into the cavity of the shell or the tail cover 2 to abut against the free end of the switch. In such manner, the free end of the switch is putted in the cavity of the shell 1 or the tail cover 2, but not extends to the hole of the tail cove 2, so that the structure form of the sealing piece needs to be changed. Another form of the sealing piece is shown in the FIG. 17, that is, the sealing piece 7 is preferably made from the silica gel material, the sealing piece 7 comprises a cylindrical main body 70, one end of the main body 70 is closed, and the other end of the main body 70 is provided with an opening; a first flange 71 is arranged on one end of the main body 70, and a second flange 72 is arranged on the other end of the main body 70; a non-closed annular groove 74 is, formed among the first flange 71, the second flange 72 and the main body 70; the hole wall of the tail cover 2 is embedded into the annular groove, so that the sealing piece 7 is clamped on the tail cover 2; and the first flange 71 is exposed in the air. After the sealing piece 7 is clamped on the tail cove 2, the sealing piece 7 can seal the hole of the tail cover 2, and due to such clamping structure, the sealing piece 7 is stably assembled on the tail cover 2 and is not easy to remove. To facilitate the assembly of the sealing piece 7, the first flange 71 is set to be the spherical shape; due to such spherical shape, when the first flange 71 and the tail cover 2 are assembled, the spherical first flange 71 is easier to penetrate through the hole of the tail cover 2, and after exposed in the air, the first flange 71 becomes a pressure application point; moreover, an operator feels, more comfortable when touching the first flange 71 with such spherical shape. An ejector rod 73 is in clearance fit with the hole of the main body 70, one end of the ejector rod 73 abuts against the inner top wall surface 75 of the first flange 71, a groove 76 is formed in the other end of the ejector rod 73, and the press rod 44 of the switch is embedded into the groove 76. In use, the pressure is applied to the first flange 71, and the pressure is transferred to the press rod 44 through the ejector rod 73, so that the switch is on to generate the pulse signal.

The above are only the embodiments of the present utility model and are not intended to limit the patent scope of the present utility model. Any equivalent structures or equivalent flow modifications made according to the description of the present utility model and applied in other relevant technical fields directly or indirectly are deemed to be included in the patent protection scope of the present utility model.

We claim:

1. A vertical power supply for a lamp, comprising a shell formed in an integrated mode and a tail cover, wherein one end of the shell is closed and the other end is provided with an opening; the tail cover is fixedly connected with the opening end of the shell; and a hole is formed in the tail cover; the vertical driving power supply for the lamp is characterized by further comprising a circuit board with a control circuit, a switch for generating a pulse signal, and a sealing piece; wherein at least one part of the circuit board is mounted in a cavity of the shell; one end of the switch is welded and fixed on the circuit board, and the other end of the switch is a free end; the sealing piece is mounted in the hole of the tail cover to seal the hole; and after the tail cover and the shell are fixed, the sealing piece abuts against the free end of the switch and one end of the sealing piece is exposed in the air.

2. The vertical power supply for a lamp according to claim 1, wherein the free end of the switch abuts against the sealing piece through the hole of the tail cover.

3. The vertical power supply for a lamp according to claim 1, wherein the axial direction of the free end of the switch and a connection point between the switch and the circuit board form an included angle larger than 0 degree.

4. The vertical power supply for a lamp according to claim 1, wherein the switch comprises an outer casing, a first conductive pin, a second conductive pin, a conductive sheet and a press rod; wherein an accommodating cavity is formed in the outer casing; one end of the first conductive pin and one end of the second conductive pin are exposed outside the outer casing; a part of the first conductive pin and a part of the second conductive pin are positioned within the accommodating cavity of the outer casing; one end of the conductive sheet is supported on the first conductive pin and the other end of the conductive sheet is connected with or abuts against one end of the press rod; and the other end of the press rod is positioned outside the outer casing.

5. The vertical power supply for a lamp according to claim 4, wherein the first conductive pin comprises a first conductive body, a first connecting body and a second connecting body; wherein one end of the first connecting body and one end of the second connecting body are connected with the first conductive body and the other end of the first connecting body and the other end of the second connecting body extend towards the second conductive pin; the conductive sheet is supported on the first connecting body and the second connecting body; and the second conductive pin comprises a second conductive body and a third connecting body, wherein one end of the third connecting body is connected with the second conductive body, and the other end of the third connecting body extends towards the first conductive pin.

6. The vertical power supply for a lamp according to claim 4, wherein the conductive sheet comprises at least a spherical first conductive sheet.

7. The vertical power supply for a lamp according to claim 1, wherein the switch comprises an outer casing, a first conductive pin, a second conductive pin, a spring, a conductive sheet and a press rod, wherein an accommodating cavity is formed in the outer casing; one end of the first conductive pin and one end of the second conductive pin are exposed outside the outer casing; a part of the first conductive pin and a part of the second conductive pin are positioned in the accommodating cavity of the outer casing; one end of the conductive sheet is supported on the first conductive pin; one end of the spring abuts against or is fixed on the bottom wall of the interior of the outer casing and the other end of the spring is connected with the conductive sheet; the other end of the conductive sheet is connected with or abuts against one end of the press rod and the other end of the press rod is positioned outside the outer casing; and the conductive sheet is positioned between the first conductive pin and the second conductive pin.

8. The vertical power supply for a lamp according to claim 1, wherein the sealing piece comprises a cylindrical main body; one end of the main body is closed, and the other end of the main body is provided with an opening; a first flange is arranged on one end of the main body, and a second flange is arranged at the other end of the main body; a non-closed annular groove is formed among the first flange, the second flange and the main body; the hole wall of the tail cover is embedded into the annular groove, so that the sealing piece is clamped on the tail cover; and the first flange is exposed in the air.

9. The vertical power supply for a lamp according to claim 1, wherein the control circuit of the circuit board comprises a direct-current power supply, a control module and a bridge driving circuit connected with an output end of the control module, wherein the control module transmits a control signal according to the pulse signal provided by the switch; the bridge driving circuit, according to the control signal provided by the control module, converts direct current input to the bridge driving circuit into accurately-controlled non-sine alternating current to output; the direct-current power supply is provided with a high-level output end directly provided for a load; and the nigh-level output end, a first output end of the bridge driving circuit and a second output end of the bridge driving circuit form an output end of the control circuit together.

10. The vertical power supply for a lamp according to claim 1, wherein a control circuit of the circuit board comprises a direct-current power supply and a control module, wherein the control module transmits a control signal according to the pulse signal provided by the switch, and the control signal converts direct current input to the control module into accurately-controlled non-sine alternating current to output; and the direct-current power supply is provided with a high-level output end directly provided for a load, and the high-level output end, a first output end of the control module and a second output end of the control module form an output end of the control circuit together.

* * * * *